US006741337B2

(12) United States Patent
Katakura et al.

(10) Patent No.: US 6,741,337 B2
(45) Date of Patent: May 25, 2004

(54) END FACE POLISHING APPARATUS AND METHOD OF POLISHING END FACE

(75) Inventors: Kazumasa Katakura, Chiba (JP); Kouji Minami, Chiba (JP)

(73) Assignee: Seiko Instruments Inc., Chiba (JP)

( * ) Notice: Subject to any disclaimer, the term of this patent is extended or adjusted under 35 U.S.C. 154(b) by 0 days.

(21) Appl. No.: 10/345,759

(22) Filed: Jan. 16, 2003

(65) Prior Publication Data

US 2004/0004710 A1 Jan. 8, 2004

(30) Foreign Application Priority Data

Jan. 24, 2002 (JP) ..... 2002-015336

(51) Int. Cl.[7] ..... G01N 21/00
(52) U.S. Cl. ..... 356/73.1
(58) Field of Search ..... 356/73.1; 385/31–34, 385/76–85, 136–137; 451/5–28, 41, 37, 57, 283–287, 384–398

(56) References Cited

U.S. PATENT DOCUMENTS 6,078,719 A * 6/2000 Wiegand et al. ..... 385/137
6,099,392 A * 8/2000 Wiegand et al. ..... 451/41
6,488,567 B1 * 12/2002 Flanders et al. ..... 451/6
6,597,835 B2 * 7/2003 Jie et al. ..... 385/33
2002/0196426 A1 * 12/2002 Stolte ..... 356/73.1

* cited by examiner

*Primary Examiner*—Tu T. Nguyen
(74) *Attorney, Agent, or Firm*—Adams & Wilks

(57) ABSTRACT

An optical fiber end face polishing apparatus has an inspection unit for introducing light into the optical fiber and detecting light from an end of the optical fiber, a moving unit for relatively moving the polishing member and the optical fiber in three directions and in a rotating direction, and a coordinate acquiring unit for acquiring a position of the polishing member while detecting the return light. A boundary between the core and clad of the optical fiber is detected with the inspection unit in at least three directions from the outer circumference of end face in its radial direction while polishing toward its axial center. The position of the center of the core is acquired as a coordinate value, and polishing is performed using the center position of the core as a reference.

20 Claims, 7 Drawing Sheets

FIG. 1A
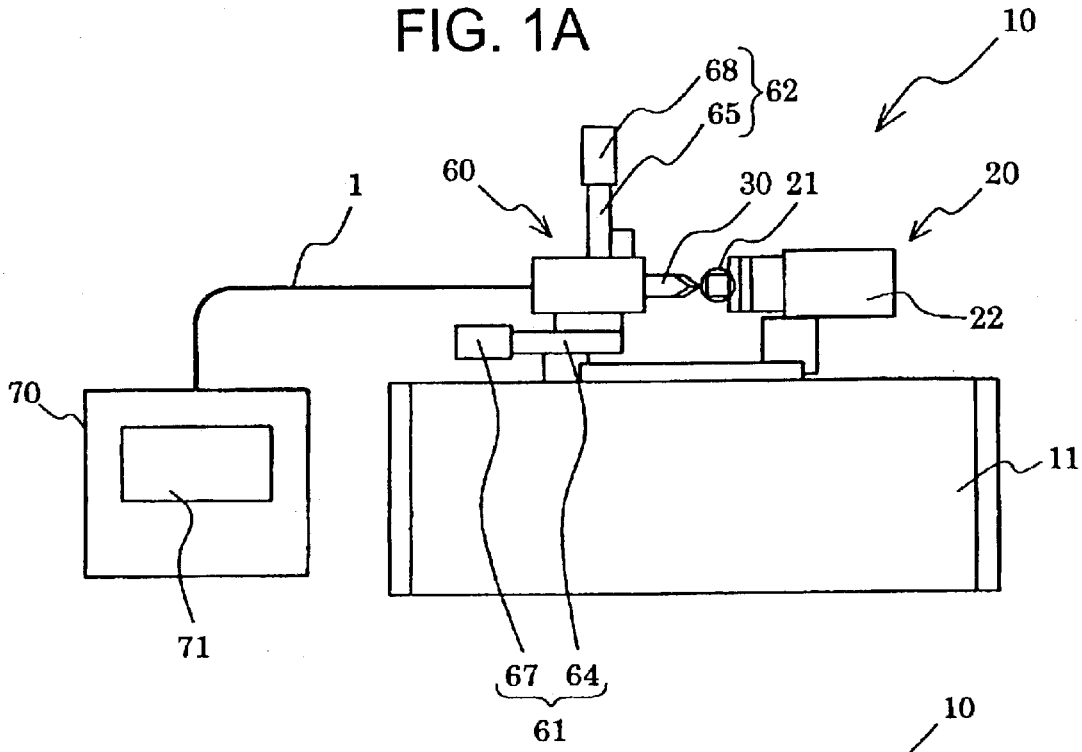
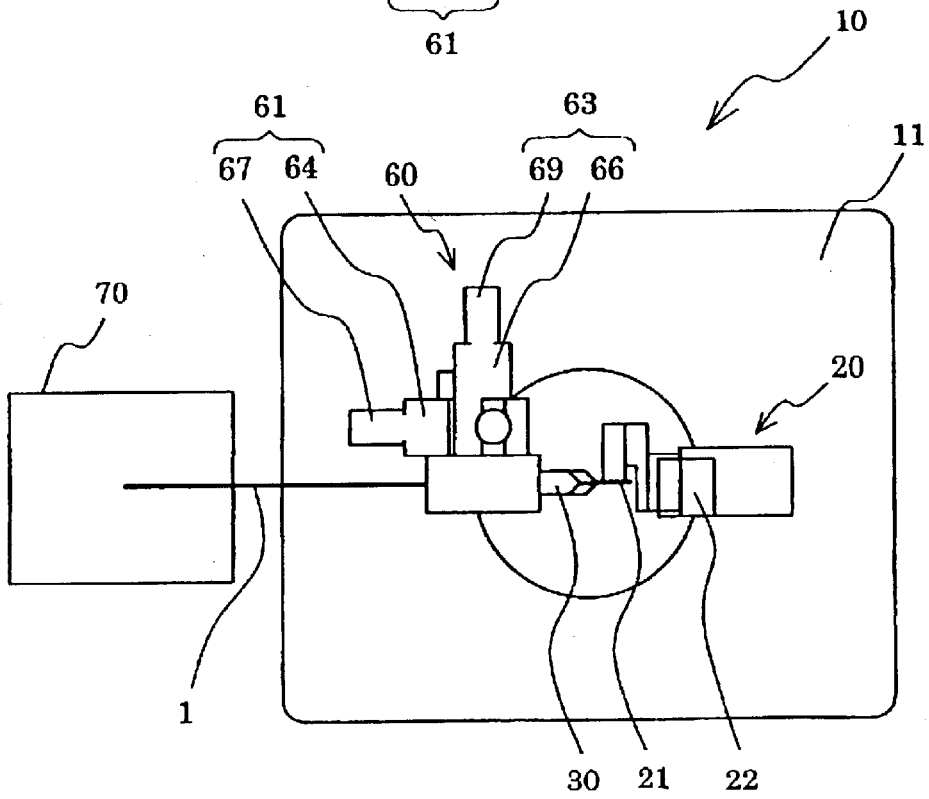
FIG. 1B

END FACE POLISHING APPARATUS AND METHOD OF POLISHING END FACE

BACKGROUND OF THE INVENTION

1. Field of the Invention

The present invention relates to an end face polishing apparatus for polishing an end of an optical fiber used for optical connection and a method of polishing an end face.

2. Description of the Related Art

To connect optical fibers to each other in a face-to-face relationship, the pair of optical fibers has been optically connected using an apparatus having a semiconductor laser provided at an end of either of the optical fibers for emitting light from the optical fiber and a pair of optical systems for collimating the light from the semiconductor laser and converging it into the other optical fiber.

Such an apparatus has a problem in that the semiconductor laser and the optical systems must be provided with high accuracy relative to a pair of optical fibers and in that a great insertion loss occurs when they are provided with low positional accuracy.

For this reason, a method has been proposed in which an end of one of optical fibers is polished into a wedge-like configuration instead of providing a semiconductor laser at the end of the optical fiber and in which light similar to that emitted by a semiconductor laser is emitted from that end.

An optical fiber having a wedge-shaped end will now be described. FIG. 7A is a perspective view of the optical fiber, and FIG. 7B is a plan view of the optical fiber taken in the direction of the wedge-shaped end face thereof.

As illustrated, an optical fiber 1 has a clad 2 and a core 3 provided in the middle of the same, and the clad 2 is formed in a wedge-like configuration. The end face where the core 3 is provided is formed such that it protrudes in the form of the character R.

When such an optical fiber 1 having a wedge-shaped end is used, there is no need for positioning required for providing a semiconductor laser, which allows steps for assembling the same to be simplified.

However, in the case of such an optical fiber that has been polished by measuring the outer diameter thereof first and by using the center of the outer diameter as the center of the core to be used as a reference, a problem has arisen in that the polishing process has poor processing accuracy even when the center of the outer diameter is used as a reference for polishing because the center of the core is offset from the outer diameter because of the accuracy of formation of the optical fiber.

In a case in which a member welded to an end of an optical fiber is polished, a problem arises in that processing accuracy is further adversely affected by an error that occurs during welding when the polishing is performed using the outer diameter of the welded member as a reference for processing.

Taking such situations into consideration, the invention is aimed at providing an end face polishing apparatus and a method of polishing an end face with which an optical fiber can be processed with improved accuracy.

SUMMARY OF THE INVENTION

In a first mode of the invention for solving the above-described problems, there is provided an end face polishing apparatus which has a polishing member rotatably provided on a main body of the apparatus and a jig for holding an optical fiber and in which an end of the optical fiber held by the jig is polished with the polishing member, characterized in that it has an inspection unit for introducing inspection light into the optical fiber and detecting return light from an end face of the optical fiber or light transmitted by the optical fiber coming from the end face, a moving unit for moving relative positions of the polishing member and the optical fiber in the direction of a Z-axis that is the axial direction of the optical fiber, in the directions of X and Y axes orthogonal to the direction of the Z-axis, and in a rotating direction about the Z-axis, and a coordinate acquiring unit for acquiring a moving position of the polishing member as a coordinate by substantially moving the polishing member with the moving unit while detecting the return light or transmitted light from the optical fiber with the inspection unit, in that the position of a boundary between a clad and a core of the optical fiber is detected with the inspection unit in at least three directions from the outer circumference of an end face of the optical fiber while moving the polishing member toward the axial center of the same, the boundary position being acquired as a coordinate with the coordinate acquiring unit, and in that the position of the center of the core is acquired as a coordinate and the end of the optical fiber is polished using the center position of the core as a reference.

In a second mode of the invention, there is provided an end face polishing apparatus in accordance with the first mode, further characterized in that the moving unit moves the optical fiber in the directions of the X-, Y-, and Z-axes and moves the polishing member in the rotating direction about the Z-axis.

In a third mode of the invention, there is provided an end face polishing apparatus in accordance with the first or second mode, further characterized in that the moving unit moves the polishing member such that a polishing surface thereof is at a predetermined angle relative to the end face of the optical fiber.

In a fourth mode of the invention, there is provided an end face polishing apparatus in accordance with any of the first through third modes, further characterized in that the acquiring unit acquires the position of the center of the polishing member as a coordinate.

In a fifth mode of the invention, there is provided an end face polishing apparatus in accordance with any of the first through fourth modes, further characterized in that the acquiring unit acquires the coordinate of the center position of the core by calculating the same from the coordinate of the position of the boundary between the clad and the core.

In a sixth mode of the invention, there is provided an end face polishing apparatus in accordance with any of the first through fifth modes, further characterized in that the polishing member polishes the end of the optical fiber along with a holding member that holds the same.

In a seventh mode of the invention, there is provided an end face polishing apparatus in accordance with any of the first through sixth modes, further characterized in that the polishing member polishes the end of the optical fiber into a wedge-like configuration or convex spherical configuration.

In an eighth mode of the invention, there is provided a method of polishing an end face of an optical fiber held by a jig with a polishing member rotatably provided on a main body of an apparatus, characterized in that it has the steps of obtaining an end face orthogonal to the axial direction of the optical fiber by polishing the end face of the optical fiber with the polishing member, acquiring the position of the center of the core as a coordinate by performing a step of polishing the optical fiber by substantially moving the polishing member toward the axial center thereof from the outer circumference in the radial direction thereof with an inspection light introduced in the optical fiber and acquiring the position of a boundary between a clad and a core of the optical fiber as a coordinate by detecting return light from the end face of the optical fiber or transmitted light from the end face of the optical fiber, the step being performed in at least three directions from different positions of rotation about the axis, and polishing the end of the optical fiber using the position of the center of the core as a reference.

In a ninth mode of the invention, there is provided a method of polishing an end face in accordance with the eighth mode, further characterized in that at the step of acquiring the position of the boundary between the clad and the core of the optical fiber as a coordinate, the coordinate is acquired from the coordinate of the center of rotation of the polishing member.

In a tenth mode of the invention, there is provided a method of polishing an end face in accordance with the eighth or ninth mode, further characterized in that a matching oil for scattering light is applied to the surface of the polishing member during polishing at the step of acquiring the position of the boundary between the clad and the core of the optical fiber as a coordinate.

In an eleventh mode of the invention, there is provided a method of polishing an end face in accordance with any of the eighth through tenth modes, further characterized in that the step of acquiring the position of the boundary between the clad and the core of the optical fiber as a coordinate is performed after forming a film made of gold on the end of the optical fiber.

In a twelfth mode of the invention, there is provided a method of polishing an end face in accordance with the eleventh mode, further characterized in that the film is formed using vacuum deposition.

In a thirteenth mode of the invention, there is provided a method of polishing an end face in accordance with any of the eighth through twelfth modes, further characterized in that at the step of polishing the end of the optical fiber, a holding member holding the end of the optical fiber is also polished.

In a fourteenth mode of the invention, there is provided a method of polishing an end face in accordance with any of the eighth through thirteenth modes, further characterized in that the end of the optical fiber is polished into a wedge-like configuration or convex spherical configuration at the step of polishing the end of the optical fiber.

According to the invention as thus described, processing accuracy can be improved because the center of a core of an optical fiber is acquired as a coordinate and polishing can be performed using the center of the core as a reference for polishing.

BRIEF DESCRIPTION OF THE DRAWINGS

FIGS. 1A and 1B are a front view and a top view, respectively, of an end face polishing apparatus according to a first embodiment of the invention;

DESCRIPTION OF THE PREFERRED EMBODIMENTS

The invention will now be described in detail based on preferred embodiments of the same.

(First Embodiment)

Figure 2A:
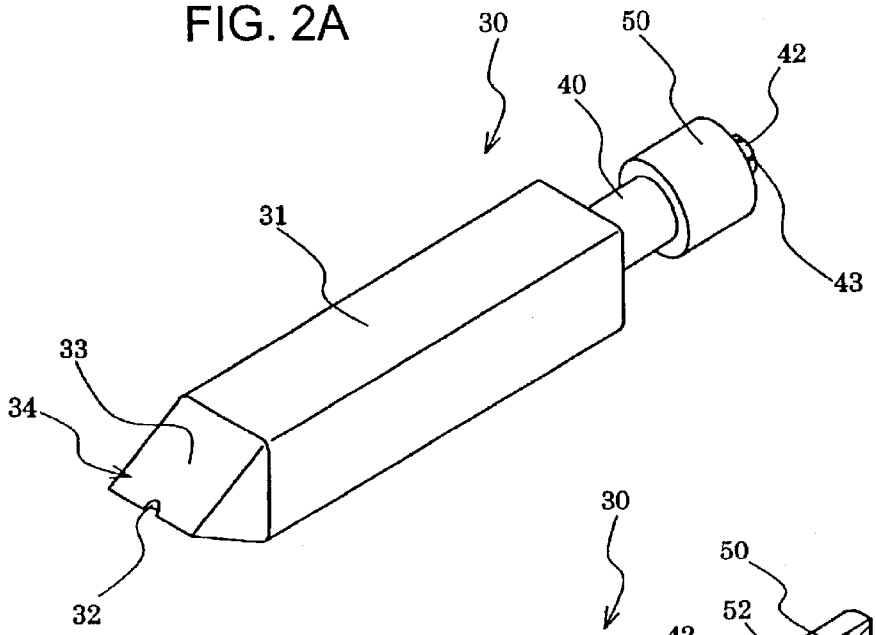
FIGS. 2A and 2B are perspective view and a partially cutaway exploded perspective view, respectively, of a jig according to the first embodiment of the invention.
Figure 2B:
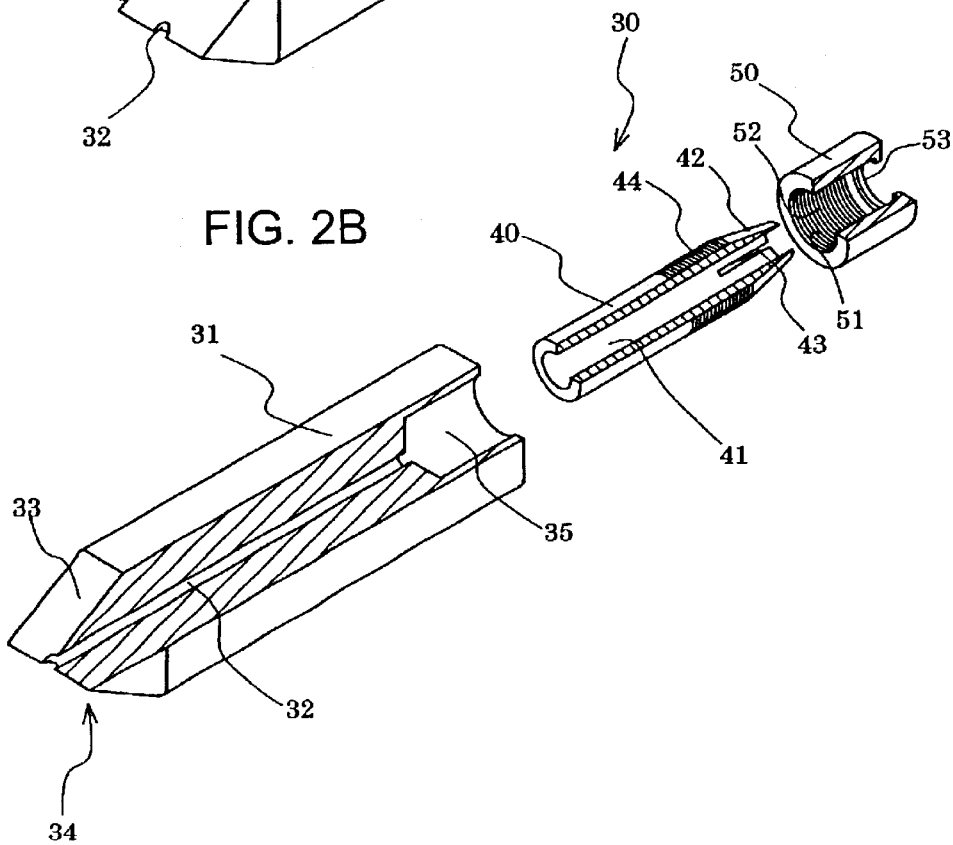
Figure 3:
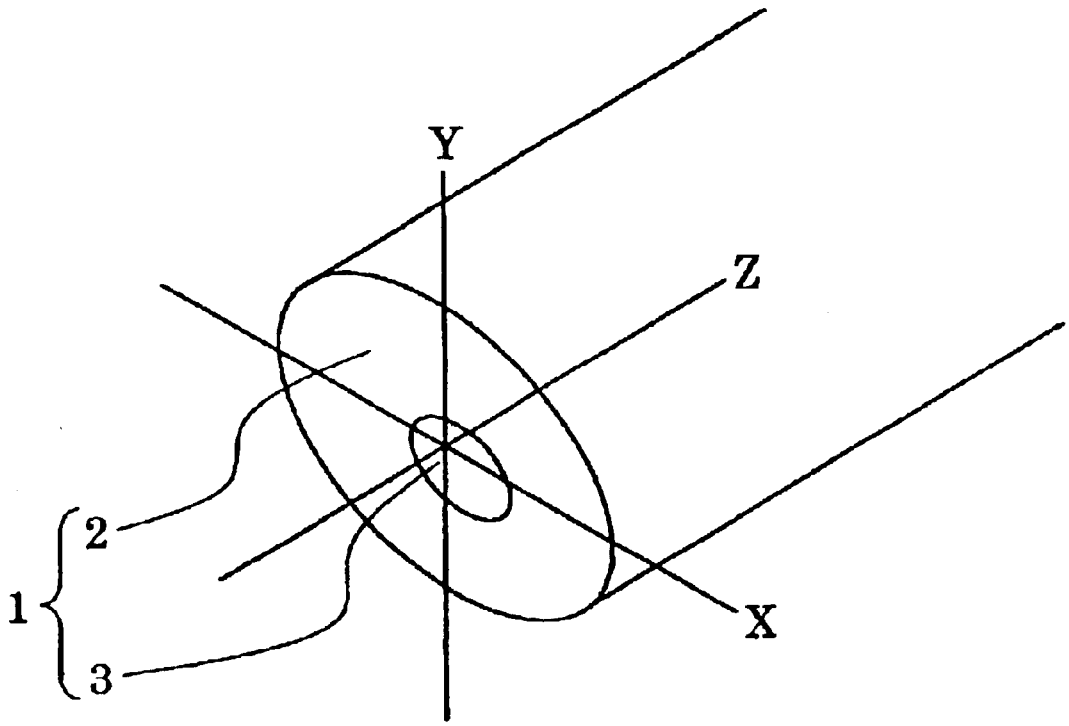
FIG. 3 is a perspective view of an unpolished optical fiber held by the end face polishing apparatus according to the first embodiment of the invention.

FIG. 1A is a front view of an end face polishing apparatus according to a first embodiment of the invention. FIG. 1B is a top view of the same. FIG. 2A is a perspective view of a jig according to the first embodiment of the invention. FIG. 2B is a partially cutaway exploded perspective view of the jig according to the first embodiment of the invention. FIG. 3 is a perspective view of an unpolished optical fiber held by the end face polishing apparatus.

As illustrated, an end face polishing apparatus 10 according to the invention has an apparatus main body 11, a polishing unit 20 on which a polishing member 21 is rotatably provided, a jig 30 for holding an optical fiber 1, a moving unit 60 for movably supporting the jig 30, and an inspection unit 70 for introducing inspection light into the optical fiber 1 and detecting return light originating from the inspection light.

While there is no special restriction on the jig 30 as long as it can hold the optical fiber 1 while keeping an end thereof in contact with the polishing member 21, in the present embodiment, it has a jig main body 31 in the form of a square pole, a holding member 40 provided at a rear end of the jig main body 31 for inserting and holding an optical fiber core, and a fastening member 50 provided around the outer circumference of the holding member 40.

The jig main, body 31 has a configuration like a square pole, and an optical fiber insertion hole 32 is provided which extends through the main body in the longitudinal direction thereof and in which the optical fiber 1 is inserted and held substantially in the middle thereof.

An end of the jig main body 31 is provided in the form of a wedge at the end of which the optical fiber insertion hole 32 opens.

Further, a holding member 40 for inserting and holding an optical fiber core that is formed by providing a jacket on the outer circumference of the optical fiber 1 is provided at a base end of the jig main body 31.

The holding member 40 has a cylindrical configuration having an optical fiber core insertion hole 41 into which the optical fiber core can be inserted in the axial direction thereof, and the fastening member 50 is engaged with the outer circumference of the base end.

An end of the holding member 40 is fitted into a fitting hole 35 which is provided at the base end of the jig main body 31 and which has an inner diameter greater than an inner diameter of the optical fiber insertion hole 32, and it is thus fixed with the optical fiber insertion hole 32 and the optical fiber core insertion hole 41 put into communication with each other.

The base end of the holding member 40 constitutes a tapered constricting section 42 whose outer diameter decreases toward an end thereof, and a plurality of cutouts 43 are provided in the axial direction of the constricting section 42.

The optical fiber core is caught and held by such a holding member 40 as a result of elastic deformation of the constricting section 42 having the cutouts 43 toward the optical fiber core insertion hole 41. There is no particular restriction on the form of the holding member 40 as long as it is a member that can catch and hold the optical fiber core as a result of elastic deformation of the constricting section 42.

An external thread 44 that engages the fastening member 50 is formed on the outer circumference of the base end of the holding member 40 for engaging the fastening member 50.

The fastening member 50 has a cylindrical configuration having an insertion hole 52 which has an inner diameter substantially equal to the outer circumference of the holding member 40 and which is formed with an internal thread 51 that engages the external thread 44 of the holding member 40 on an inner surface thereof, and an urging section 53 having an inner diameter smaller than the inner diameter of the insertion hole 52 is provided at an end of the insertion hole 52.

When the fastening member 50 is engaged with the outer circumference of the holding member 40, the urging section 53 slidably contacts an outer surface of the constricting section 42 of the holding member 40 to elastically deform the constricting section 42 toward the optical fiber core insertion hole 41, thereby holding the optical fiber core.

Such a jig 30 makes it possible to reliably hold and fix the optical fiber 1 and to accurately polish an end of the optical fiber 1 with the polishing member 21.

The optical fiber 1 that is held by the end face polishing apparatus 10 of the present embodiment before polishing has a clad 2 and a core 3 as shown in FIG. 3, and an end face of the same is formed in a planar configuration.

In the present embodiment, the moving unit 60 for movably supporting the jig 30 shown in FIG. 1 supports the jig 30 such that it can move in the direction of a Z-axis that is the axial direction of the optical fiber 1 and in the directions of X- and Y-axes orthogonal to the Z-axis as shown in FIG. 3, and it also serves as an acquisition unit for acquiring the quantity of a movement.

Such a moving unit 60 has a Z-axis moving unit 61 for moving the jig 30 in the direction of the Z-axis that is the axial direction of the optical fiber 1, an X-axis moving unit 62 for moving the jig 30 in the direction of the X-axis that is orthogonal to the Z-axis direction of the optical fiber 1, and a Y-axis moving unit 63 for moving the jig 30 in the direction of the Y-axis that is orthogonal to the Z-axis direction of the optical fiber 1 and that is also orthogonal to the X-axis direction.

For example, such Z-axis moving unit 61, X-axis moving unit 62, and Y-axis moving unit 63 are respectively constituted of a Z-axis feed table 64, an X-axis feed table 65, and a Y-axis feed table 66 that are provided such that they move in the respective directions and a Z-axis adjusting unit 67, an X-axis adjusting unit 68, and a Y-axis adjusting unit 69 each of which is fixed at an end thereof to be able to acquire the quantity of a movement or a distance from a predetermined position of the apparatus main body 11 as a coordinate, the adjusting units being constituted of micrometer heads, for example.

The jig 30 can be moved by such a moving unit 60 in the direction of the Z-axis that is the axial direction of the optical fiber 1 and in the directions of the X-axis and the Y-axis orthogonal to the direction of the Z-axis to polish an end of the optical fiber 1 in each of the directions.

Since the Z-axis adjusting unit 67, the X-axis adjusting unit 68, and the Y-axis adjusting unit 69 can acquire the quantity of a movement or a distance from a predetermined position of the apparatus main body 11 as a coordinate, the quantity of a movement of the jig 30 from an initial position thereof may be acquired as a coordinate as it is and the distance of the same from a predetermined position of the apparatus main body 11 may alternatively be acquired as a coordinate.

The polishing unit 20 has a polishing member 21 constituted of a disk-shaped polishing grind stone that is rotatably provided and a polishing moving unit 22 for moving a polishing surface of the rotating polishing member 21 such that it contacts the optical fiber 1 at a predetermined angle to the axial direction thereof and for moving the polishing surface of the polishing member 21 in a circumferential direction the optical fiber.

Such a polishing moving unit 22 of the polishing unit 20 makes it possible to acquire the position of the center of the core 3 of the optical fiber 1 shown in FIG. 3 as a coordinate and to form a wedge-like feature at the end of the optical fiber using the core center as a reference, although details will be described later.

The inspection unit 70 is provided to introduce inspection light into the optical fiber 1 and to allow the state of polishing of the optical fiber 1 to be checked by detecting return light or transmitted light originating from the inspection light, and an attenuation of return light is measured with the inspection unit 70 in the present embodiment.

A display 71 such as a monitor is provided on the inspection unit 70, which makes it possible to measure and display the attenuation continually during a polishing process on the optical fiber 1 to allow the state of polishing of the optical fiber 1 to be checked.

The measurement of the attenuation of return light with such an inspection unit 70 may be continually performed during a polishing process, and it may alternatively be performed when polishing has proceeded to the neighborhood of the core 3 of the optical fiber 1.

The return light is light resulting from reflection of the inspection light irradiating the end face of the optical fiber 1 or the polishing member 21 such as a polishing grind stone. While the reflection factor varies depending on the shape of the end face of the optical fiber 1 or the quality and roughness of the polishing member 21, a great change in attenuation occurs at the instant when polishing proceeds from the clad 2 into the core 3 after starting at the outer circumference of the optical fiber 1 in the radial direction thereof with the polishing member 21 unchanged. Therefore, the boundary between the clad 2 and the core 3 can be easily detected with the polishing member by measuring the attenuation during the polishing process.

While the attenuation of return light depends on the quality and roughness of the polishing member 21 as described above, a matching oil may be applied to the surface of the polishing member 21 for optical index matching. By applying such a matching oil, light can be scattered to make it easy to measure a change in the attenuation of return light. When the optical fiber 1 is polished with a matching oil applied on the surface of the polishing member 21, the end of the optical fiber 1 must be cleaned to remove the matching oil after the polishing process.

Further, a film made of gold may be formed on the end of the optical fiber 1 before a polishing process using vacuum deposition, for example.

When such a film made of gold is provided on the polished surface of the optical fiber 1, while no attenuation of return light occurs during polishing of the clad 2, a very small change in attenuation during polishing of the core 3 can be easily measured. Such a film may be removed by polishing the end of the optical fiber 1.

In the present embodiment, steps for polishing the optical fiber 1 with the polishing unit 20 are categorized into polishing steps for acquiring the center of the core 3 as a coordinate and polishing and processing steps for polishing the end of the optical fiber 1 into a wedge-like configuration or a convex spherical configuration.

A detailed description will now be made on end face polishing steps for polishing an end of an optical fiber using such an end face polishing apparatus.

FIGS. 4A to 6B are sectional views showing steps for polishing an optical fiber.

Figure 4A:
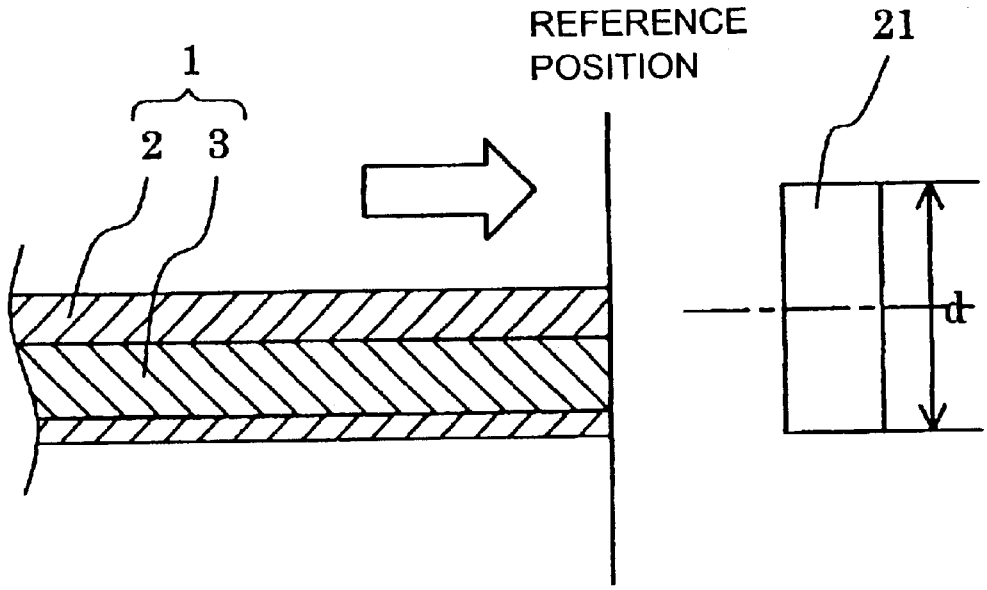
FIGS. 4A and 4B are sectional views showing a method of polishing an end face of an optical fiber according to the first embodiment of the invention.
Figure 4B:
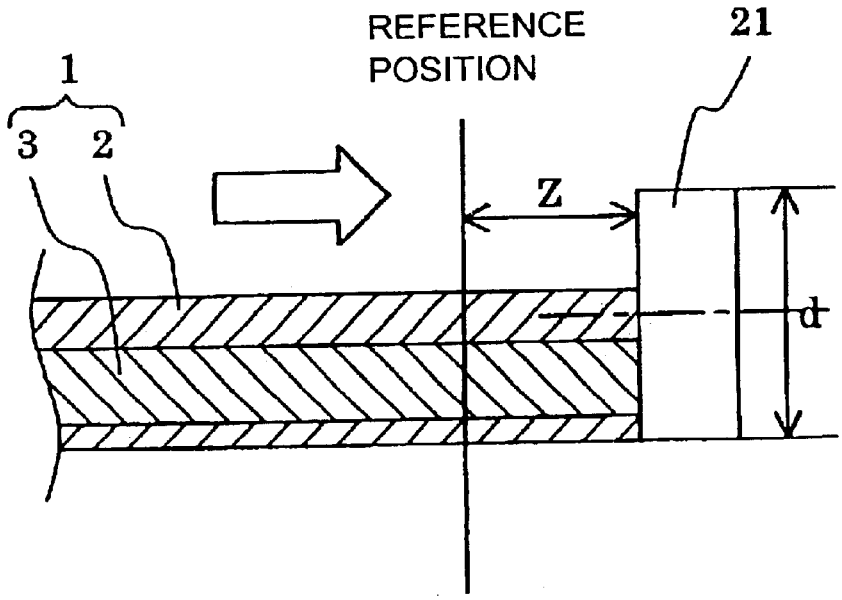

First, the jig 30 is moved by the Z-axis moving unit 61 from a position in which an end face of an optical fiber 1 does not contact the polishing member 21 in the direction of the Z-axis that is the axial direction of the optical fiber 1 as shown in FIG. 4A to form an end face orthogonal to the Z-axis direction on the optical fiber 1 with the polishing member 21 that rotates as shown in FIG. 4B.

The quantity of the movement caused by the Z-axis moving unit 61 at this time is acquired to find a Z-coordinate of the core 3 of the optical fiber 1.

The quantity of a movement from a reference position that is an initial state of the jig 30 may be acquired as the Z-coordinate, and it may alternatively be acquired as a distance from a predetermined position of the apparatus main body 11 as a reference.

Next, coordinates of the center of the core 3 in the directions of the X-axis and Y-axis are acquired.

Figure 5A:
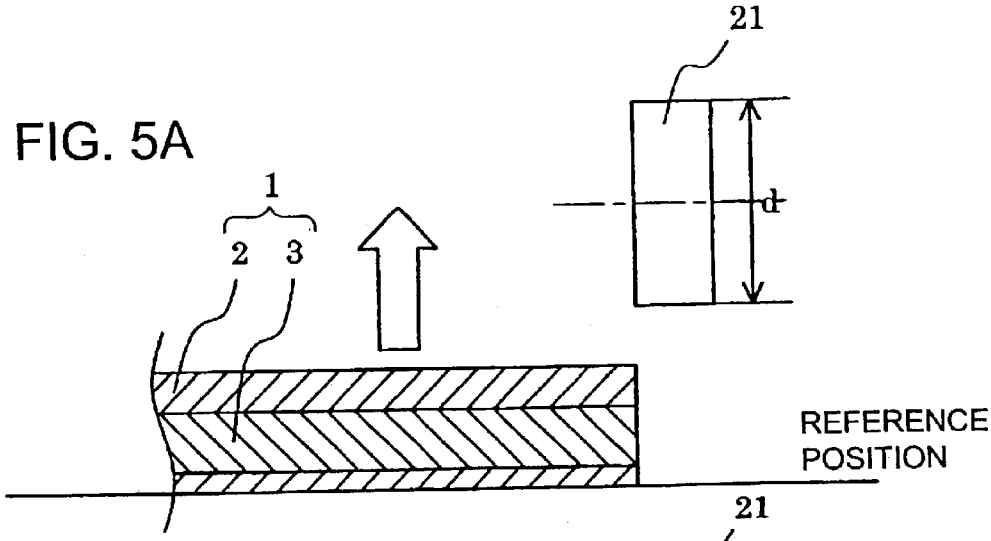
FIGS. 5A, 5B, and 5C are sectional view showing the method of polishing an end face of an optical fiber according to the first embodiment of the invention.
Figure 5B:
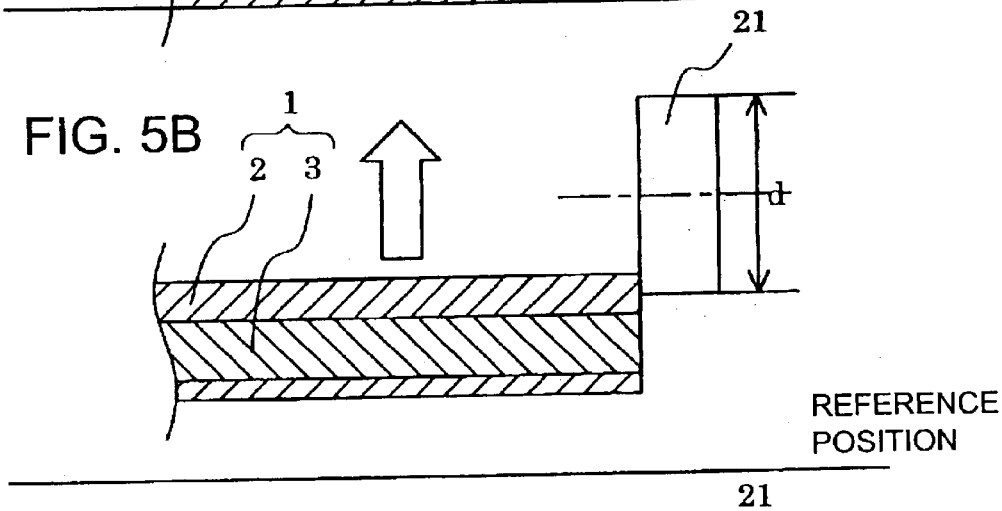

Referring to the acquisition of the coordinate of the center of the core 3 in the direction of the X-axis, in the state in which the optical fiber 1 does not contact the polishing member 21 with inspection light introduced in the optical fiber 1 by the inspection unit 70, the jig 30 is first moved by the X-axis moving unit 62 in one X-axial direction relative to the polishing member 21 that is rotating as shown in FIG. 5A, which allows the clad 2 to be polished from the outer circumference of the optical fiber 1 in the radial direction thereof toward the center of the axis thereof, as shown in FIG. 5B.

When return light from the end face of the optical fiber 1 is detected with the inspection unit 70 at this time, the return light detected by the inspection unit 70 has a substantially constant attenuation.

Figure 5C:
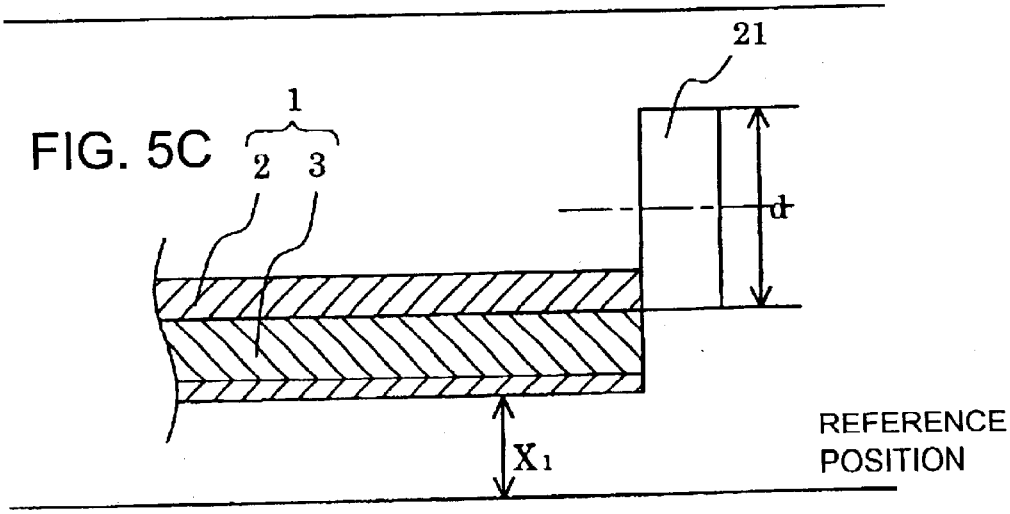

Polishing is continued thereafter by moving the optical fiber 1, and the attenuation of the return light detected by the inspection unit 70 abruptly changes when the edge of the polishing member 21 reaches the position of a boundary between the clad 2 and core 3 of the optical fiber 1 as shown in FIG. 5C. This indicates that the edge of the polishing member 21 has reached an edge of the core 3.

At this time, a coordinate $X_1$ in the direction of the X-axis as shown in FIG. 5A is acquired by the X-axis moving unit 62. In the present embodiment, the coordinate $X_1$ is acquired as a distance the jig 30 has moved using the position of the same shown in FIG. 5A as a reference position.

Figure 6A:
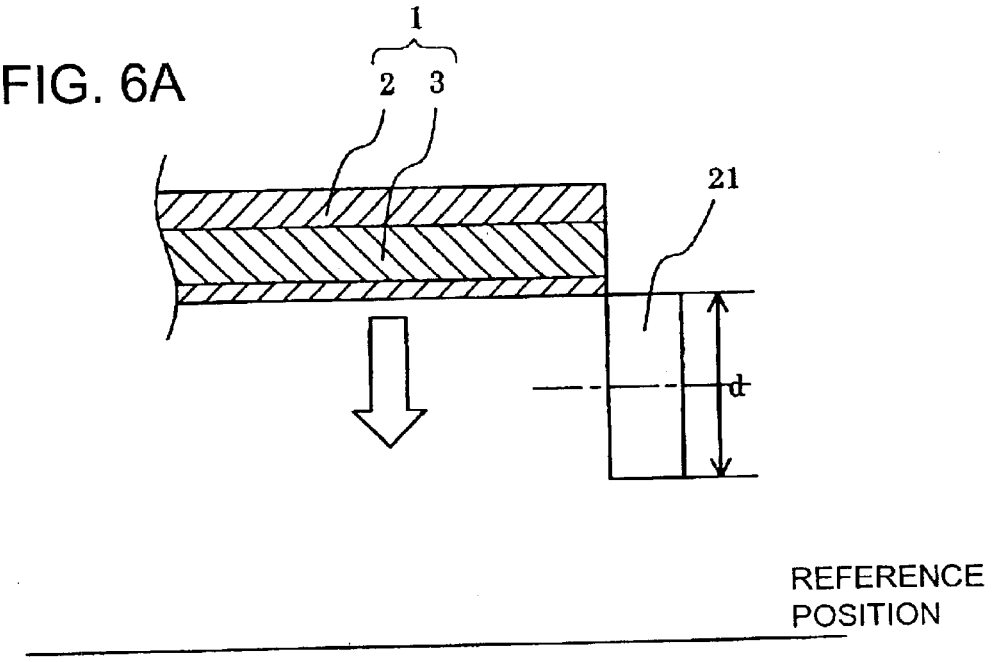
FIGS. 6A and 6B are sectional views showing the method of polishing an end face of an optical fiber according to the first embodiment of the invention.

Next, from the state in which the optical fiber 1 is not in contact with the polishing member 21, the jig 30 is moved in another X-axial direction relative to the rotating polishing member 21 with the X-axis moving unit 62 as shown in FIG. 6A, thereby polishing the clad 2 toward the axial center thereof from the outer circumference of the optical fiber 1 in the radial direction thereof.

When return light from the end face of the optical fiber 1 is detected with the inspection unit 70 at this time, the return light detected by the inspection unit 70 has a substantially constant attenuation.

Figure 6B:
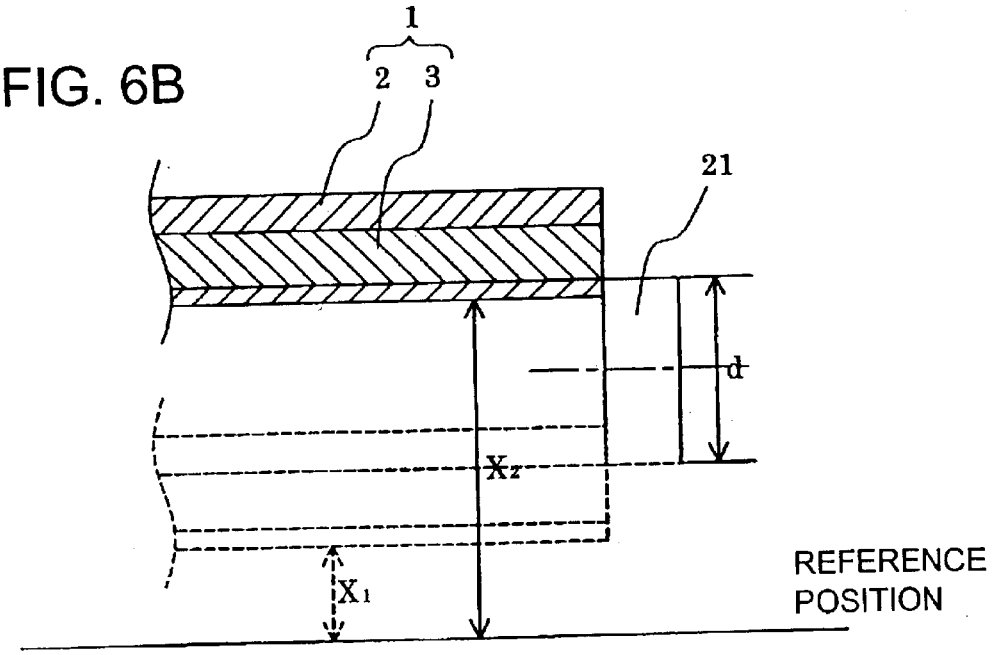

Polishing is continued thereafter by moving the optical fiber 1, and the attenuation of the return light detected by the inspection unit 70 abruptly changes when the edge of the polishing member 21 reaches the position of a boundary between the: clad 2 and core 3 of the optical fiber 1 as shown in FIG. 6B. This indicates that the edge of the polishing member 21 has reached an edge of the core 3.

At this time, a coordinate $X_2$ in the direction of the X-axis as shown in FIG. 6B is acquired by the X-axis moving unit 62. The coordinate $X_2$ is also acquired using the position of the jig 30 shown in FIG. 5A as a reference position.

Thus, the X-coordinates $X_1$ and $X_2$ corresponding to the edges of the core 3 on both sides thereof in the direction of the X-axis can be acquired by polishing the optical fiber 1 from outer circumferential positions of the optical fiber 1 on both sides thereof in the direction of the X-axis.

The X-coordinate of the center of the core 3 in the direction of the X-axis can be calculated as $(X_2-d-X_1)/2$ from the acquired coordinates $X_1$ and $X_2$ corresponding to edges of the core 3 on both sides thereof in the direction of the X-axis.

Similarly to the series of operations of acquiring the coordinate of the center of the core 3 in the direction of the X-axis, a coordinate of the same in the direction of the Y-axis is also acquired, and coordinates of the center of the core 3 on the X- and Y-axes and a coordinate of the same on the Z-axis can be thus acquired. The coordinate of the core in the direction of the Y-axis can be easily acquired similarly to the acquisition of the X-coordinate by moving the polishing member 21 in a rotating direction about the axis of the optical fiber 1 with the moving unit 22 of the polishing unit 20.

Figure 7A:
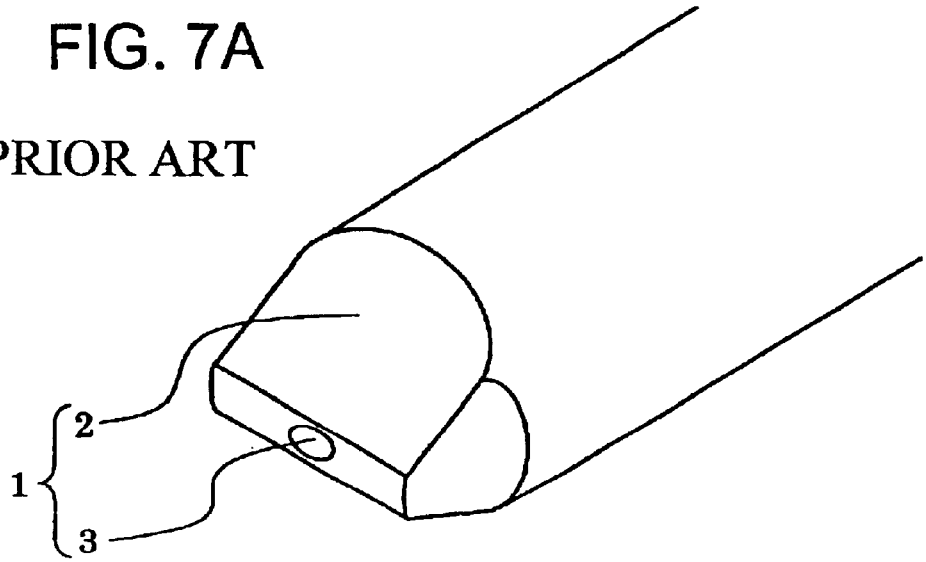
FIG. 7A PRIOR ART
FIGS. 7A and 7B are a perspective view of an optical fiber according to the related art and a plan view of the same taken from the side of an end face thereof, respectively.
Figure 7B:
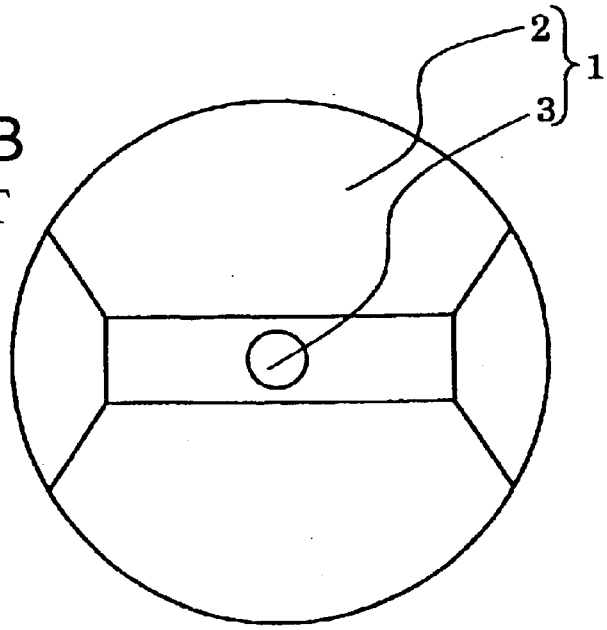
FIG. 7B PRIOR ART

After acquiring the coordinate of the center of the core 3, the end of the optical fiber 1 can be accurately polished into a wedge-like configuration as shown in FIGS. 7A and 7B or spherical configuration as described in the section of the related art by polishing the same using the center of the core 3 as a reference for polishing.

For, example, a wedge-like feature can be easily and accurately formed at the end of the optical fiber 1 by moving the polishing surface of the polishing member 21 such that it is at a predetermined angle to the axial direction of the optical fiber 1 with the polishing moving unit 22 of the polishing unit 20.

(Other Embodiments)

The end face polishing apparatus and the method of polishing an end face according to the invention are not limited to the above-described first embodiment.

For example, in the above-described first embodiment, the jig 30 holding the optical fiber 1 is moved by the moving unit 60 in the direction of the Z-axis that is the axial direction of the optical fiber 1 and in the directions of the X- and Y-axes that are orthogonal to the direction of the Z-axis, and the rotating direction of the same about the Z-axis is relatively moved with the polishing moving unit 22. However, this is not intended to limit the invention, and what is required is that the relative positions of the optical fiber 1 and the polishing member 21 can be moved in each of the directions. Therefore, the polishing member 21 may be moved in the directions of the X-, Y- and Z-axes and in a rotating direction about the Z-axis with the jig 30 holding the optical fiber 1 fixed, for example.

Improved polishing accuracy can be achieved in such a way by acquiring the coordinate of the center of the core 3 as in the above-described first embodiment.

While the above-described first embodiment has shown an example of a method of polishing an end face in which the end of the optical fiber 1 is finally polished into a wedge-like configuration or convex spherical configuration, accurate polishing can be reliably performed by acquiring the coordinate of the center of the core 3 of the optical fiber 1 and performing polishing using the coordinate of the center of the core 3 as a reference regardless of the configuration into which the end of the optical fiber 1 is to be polished.

For example, such highly accurate polishing can be easily performed even when a ferrule is provided on the end of the optical fiber 1 to hold the optical fiber 1 because polishing can be performed using the center of the core 3 of the optical fiber 1 as a reference by acquiring the coordinate of the center of the core 3 of the optical fiber 1 using a structure in which the ferrule can be held with the jig 30 by providing a jig main body 31 of the jig 30 with an insertion hole that allows the ferrule to be held therein or using a configuration in which the ferrule can be directly held by the moving unit 60.

As described above, the end face polishing apparatus of the invention makes it possible to perform accurate polishing easily for improved processing accuracy because the center of a core of an optical fiber can be identified as a coordinate and polishing can be performed using the center of the core as a reference for polishing. Further, the method of polishing an end face according to the invention makes it possible to acquire the coordinate of the center of the core easily and reliably.

What is claimed is:

1. An end face polishing apparatus which has a polishing member rotatably provided on a main body of the apparatus and a jig for holding an optical fiber and in which an end of the optical fiber held by the jig is polished with the polishing member, comprising:

an inspection unit for introducing inspection light into the optical fiber and detecting return light from an end face of the optical fiber or light transmitted by the optical fiber coming from the end face of the optical fiber;

a moving unit for moving relative positions of the polishing member and the optical fiber in the direction of a Z-axis that is the axial direction of the optical fiber, in the directions of X and Y axes orthogonal to the direction of the Z-axis, and in a rotating direction about the Z-axis; and a coordinate acquiring unit for acquiring a moving position of the polishing member as a coordinate value by substantially moving the polishing member with the moving unit while detecting the return light or the transmitted light from the optical fiber with the inspection unit, so that the position of a boundary between a clad and a core of the optical fiber can be detected with the inspection unit in at least three directions from the outer circumference of an end face of the optical fiber while moving the polishing member toward the axial center of the optical fiber, the boundary position being acquired as a coordinate value with the coordinate acquiring unit, and wherein the position of the center of the core is acquired as a coordinate value and the end of the optical fiber is polished using the center position of the core as a reference.

2. An end face polishing apparatus according to claim 1; wherein the moving unit moves the optical fiber in the directions of the X-, Y-, and Z-axes and moves the polishing member in the rotating direction about the Z-axis.

3. An end face polishing apparatus according to claim 1; wherein the moving unit moves the polishing member such that a polishing surface thereof is at a predetermined angle relative to the end face of the optical fiber.

4. An end face polishing apparatus according to claim 2; wherein the moving unit moves the polishing member such that a polishing surface thereof is at a predetermined angle relative to the end face of the optical fiber.

5. An end face polishing apparatus according to claim 1; wherein the acquiring unit acquires the position of the center of the polishing member as a coordinate value.

6. An end face polishing apparatus according to claim 2; wherein the acquiring unit acquires the position of the center of the polishing member as a coordinate value.

7. An end face polishing apparatus according to claim 3; wherein the acquiring unit acquires the position of the center of the polishing member as a coordinate value.

8. An end face polishing apparatus according to claim 1; wherein the acquiring unit calculates the coordinate of the center position of the core based upon the coordinate of the position of the boundary between the clad and the core.

9. An end face polishing apparatus according to claim 1; wherein the polishing member polishes the end of the optical fiber along with a holding member that holds the optical fiber.

10. An end face polishing apparatus according to claim 1; wherein the polishing member polishes the end of the optical fiber into a wedge-like configuration or convex spherical configuration.

11. A method of polishing an end face of an optical fiber held by a jig with a polishing member rotatably provided on a main body of a polishing apparatus, comprising the steps of:

obtaining an end face orthogonal to the axial direction of the optical fiber by polishing the end face of the optical fiber with the polishing member;

acquiring the position of the center of the core as a coordinate value by polishing the optical fiber using the polishing member by moving the polishing member relative to the optical fiber in a direction toward the axial center of the optical fiber from the outer circumference in the radial direction of the optical fiber while introducing an inspection light in the optical fiber, and acquiring the position of a boundary between a clad and a core of the optical fiber as a coordinate value by detecting return light from the end face of the optical fiber or transmitted light from the end face of the optical fiber, the step of acquiring the position of the boundary between the clad and the core of the optical fiber being performed in at least three directions from different positions of rotation about an axis; and polishing the end of the optical fiber using the position of the center of the core as a reference.

12. A method of polishing an end face of an optical fiber according to claim 11; wherein the step of acquiring the position of the boundary between the clad and the core of the optical fiber as a coordinate value comprises acquiring the coordinate value from the coordinate value of the center of rotation of the polishing member.

13. A method of polishing an end face of an optical fiber according to claim 11; further comprising the step of applying a matching oil to the surface of the polishing member for scattering light while polishing the optical fiber during the step of acquiring the position of the boundary between the clad and the core of the optical fiber as a coordinate value.

14. A method of polishing an end face of an optical fiber according to claim 12; further comprising the step of applying matching oil to the surface of the polishing member for scattering light while polishing the optical fiber during the step of acquiring the position of the boundary between the clad and the core of the optical fiber as a coordinate value.

15. A method of polishing an end face of an optical fiber according to claim 11; further comprising the step of forming a cold film on an end of the optical fiber prior to performing the step of acquiring the position of the boundary between the clad and the core of the optical fiber as a coordinate value.

16. A method of polishing an end face of an optical fiber according to claim 12; further comprising the step of forming a gold film on an end of the optical fiber prior to performing the step of acquiring the position of the boundary between the clad and the core of the optical fiber as a coordinate value.

17. A method of polishing an end face of an optical fiber according to claim 13; further comprising the step of forming a cold film on an end of the optical fiber prior to performing the step of acquiring the position of the boundary between the clad and the core of the optical fiber as a coordinate value.

18. A method of polishing an end face of an optical fiber according to claim 17; wherein the step of forming the cold film is performed by vacuum deposition.

19. A method of polishing an end face of an optical fiber according to claim 11; wherein the step of polishing the end of the optical fiber is performed while the optical fiber is held by a holding member with the end of the optical fiber protruding therefrom such that a contact surface of the holding member is polished while the ed of the optical fiber is being polished.

20. A method of polishing an end face of an optical fiber according to claim 11; the step of polishing the end of the optical fiber comprises the step of polishing the end of the optical fiber into a wedge-like configuration or convex spherical configuration.

* * * * *